US010418199B2

(12) United States Patent
Lee et al.

(10) Patent No.: US 10,418,199 B2
(45) Date of Patent: Sep. 17, 2019

(54) RETROFITTABLE SWITCH GUARD

(71) Applicant: Eaton Corporation, Cleveland, OH (US)

(72) Inventors: Davin Robert Lee, Watertown, WI (US); Richard William Fitzgerald, Franklin, WI (US); Robert W. Nickerson, Germantown, WI (US); Dana Kathryn Leland, Milwaukee, WI (US)

(73) Assignee: Eaton Intelligent Power Limited, Dublin (IE)

( * ) Notice: Subject to any disclaimer, the term of this patent is extended or adjusted under 35 U.S.C. 154(b) by 199 days.

(21) Appl. No.: 14/264,208

(22) Filed: Apr. 29, 2014

(65) Prior Publication Data

US 2015/0311010 A1 Oct. 29, 2015

(51) Int. Cl.
*H01H 9/28* (2006.01)
*H01H 23/04* (2006.01)

(52) U.S. Cl.
CPC ..... *H01H 9/287* (2013.01); *H01H 23/04* (2013.01); *H01H 2300/024* (2013.01)

(58) Field of Classification Search
CPC ..... H01H 9/287; H01H 9/22; H01H 23/04; H01H 23/14
USPC ..... 200/43.16, 43.01
See application file for complete search history.

(56) References Cited

U.S. PATENT DOCUMENTS

| | | | | | |
|---|---|---|---|---|---|
| 2,141,936 | A * | 12/1938 | Schmitt | H01H 23/14 | 200/304 |
| 5,486,660 | A | 1/1996 | Fasano | | |
| 5,757,618 | A * | 5/1998 | Lee | G06F 1/184 | 361/679.32 |
| 5,907,140 | A * | 5/1999 | Smith | H01H 9/287 | 200/43.16 |
| 5,999,072 | A | 12/1999 | Slavik | | |
| 6,137,068 | A * | 10/2000 | Padulo | H01H 9/287 | 200/43.16 |
| 6,365,851 | B1 * | 4/2002 | Gasper | H01H 9/08 | 200/43.16 |
| 7,521,642 | B2 * | 4/2009 | Belanger | H01H 23/14 | 200/332.2 |
| 2013/0161962 | A1 | 6/2013 | Fitzgerald et al. | | |

FOREIGN PATENT DOCUMENTS

EP 0694947 A1 1/1996

* cited by examiner

*Primary Examiner* — Felix O Figueroa
(74) *Attorney, Agent, or Firm* — Ziolkowski Patent Solutions Group, SC

(57) ABSTRACT

A switch guard for preventing accidental actuation of a control switch is disclosed. The switch guard includes a rigid wall structure comprising a pair of side walls and a pair of end walls arranged to accommodate positioning of the control switch therein, each of the pair of end walls including at least one opening formed therein. The switch guard also includes a mating feature provided at each of the end walls of the wall structure, with each mating feature being a separate component from the rigid wall structure and being configured to selectively translate through the at least one opening formed in the respective end wall between a first position and a second position to secure the switch guard about the control switch.

19 Claims, 6 Drawing Sheets

RETROFITTABLE SWITCH GUARD

BACKGROUND OF THE INVENTION

The present invention relates generally to vehicle control switches for use in motor vehicles and, more particularly, to a switch guard useable with such switches. The switch guard is retrofittable with vehicle control switches of various types—including rocker switches, push-button switches and toggle switches—and can be selectively added thereto to prevent accidental actuation of such switches.

In specialty vehicle markets—such as heavy trucks, agricultural equipment, and construction equipment, for example—electrical switches are used as control switches for a variety of applications, including switching the motor vehicle lighting, the windshield wipers, the rear windshield heating, the cruise control functions, the internal central locking and other functions on and off. A number of such vehicle control switches can be combined as control panels in the vehicle dashboard, in the center console, or the like. Often the vehicle control switches are in the form of rocker switches that may be pushed by an operator to rotate/tilt from a neutral position (i.e., switched-off state) to one or more activated positions (i.e., a switched-on state) that control operation of an associated vehicle system/component. Pushbutton switches and toggle switches are also switches oftentimes employed as vehicle control switches.

It is recognized that, due to their design and manner in which they are actuated, it is possible for rocker-type, pushbutton, and toggle vehicle control switches to be moved by an operator in an accidental fashion. In order to prevent such accidental actuation of these switches, various mechanisms or controls have previously been employed with respect to activation of such switches. As one example, critical and safety related control switches may often include some sort of redundancy feature in which two separate actions are required by an operator to actuate the switch, so as to prevent accidental actuation of the switch. As another example, a switch guard may be positioned about a rocker switch to prevent accidental actuation thereof.

With respect to existing switch guards that are implemented to prevent accidental actuation of a switch, such switch guards are constructed as a plastic guard that uses plastic snap-fit fingers to attach it to the switch housing. As such, these switch guards require the guard material to be flexible enough to allow it to snap in place. While this flexibility of the switch guard enables it to be snapped/secured to the switch housing in an easy fashion, the switch guard does not provide the rigidity that is desired in order for the switch guard to adequately prevent accidental actuation of the switch and/or a desired durability that prevents the switch guard from breaking Another drawback of existing switch guards is that these guards typically come pre-installed on their associated switches. For multi-switch modules that include a number of switches therein in a common housing (i.e., three or more switches in one housing)—such as is typical with rocker switches—this means that each switch in the module will include a switch guard thereon. However, it is recognized that only certain rocker switches in the switch module may require a switch guard—such as critical and safety related switches—and that the inclusion of switch guards on the other rocker switches may be deemed undesirable/unnecessary by a customer.

It would therefore be desirable to provide a switch guard for a vehicle control switch that is easily attachable while still providing protection against accidental actuation of the switch. It would further be desirable for such a switch guard to be retrofittable to an existing unguarded multi-switch module, so as to enable a customer to add the switch guards where needed on the multi-switch module so as to provide any one of a number of combinations of guarded and unguarded switches in the module.

BRIEF DESCRIPTION OF THE INVENTION

Embodiments of the present invention provide a retrofittable switch guard that can be selectively attached to a switch housing in order to prevent accidental actuation of the switch. The switch guard is constructed to have a rigidity that prevents the guard from being broken or defeated by the operator, while including a mating feature that allows for the switch guard to be easily secured to the switch housing.

In accordance with one aspect of the invention, a switch guard for preventing accidental actuation of a control switch includes a rigid wall structure comprising a pair of side walls and a pair of end walls arranged to accommodate positioning of the control switch therein, each of the pair of end walls including at least one opening formed therein. The switch guard also includes a mating feature provided at each of the end walls of the wall structure, with each mating feature being a separate component from the rigid wall structure and being configured to selectively translate through the at least one opening formed in the respective end wall between a first position and a second position to secure the switch guard about the control switch.

In accordance with another aspect of the invention, a vehicle control switch includes a control switch switchable between ON and OFF states responsive to physical actuation of the control switch by an operator, the physical actuation comprising an application of force onto the control switch by the operator. The vehicle control switch also includes a switch housing to receive the control switch therein, with the switch housing comprising a switch mount having one or more mating slots formed therein. The vehicle control switch further includes a switch guard secured to the switch housing and positioned about the control switch, the switch guard having a wall structure defining a volume to receive the control switch therein and a depressible mating feature positioned on each of opposing ends of the wall structure, the depressible mating feature configured to selectively mate with the one or more mating slots formed in the switch housing to secure the switch guard to the switch housing.

In accordance with yet another aspect of the invention, a retrofittable rocker switch guard for preventing accidental actuation of a rocker switch includes a rigid wall structure configured to accommodate positioning of a rocker switch therein, the rigid wall structure including one or more openings formed on each of opposing ends thereof. The retrofittable rocker switch guard also includes a spring pin retained in each of the one or more openings and being translatable therethrough to provide securing of the rigid wall structure about the rocker switch, wherein each spring pin is depressible so as to vary a diameter thereof from a diameter larger than a diameter of its respective opening in which it is retained to a diameter that provides for placement of the spring pin within the opening and translation therethrough, and wherein each spring pin exerts a radial force against the opening in which it is retained so as to secure the spring pin in the opening in a fixed position.

Various other features and advantages of the present invention will be made apparent from the following detailed description and the drawings.

BRIEF DESCRIPTION OF THE DRAWINGS

The drawings illustrate preferred embodiments presently contemplated for carrying out the invention.

In the drawings.

DETAILED DESCRIPTION OF THE INVENTION

Embodiments of the invention are directed to a switch guard for use with various switch types—including rocker switches, push-button switches and toggle switches—to prevent accidental actuation of a switch. While the use of such switch guards are described here below as being employed on vehicle control switches and switch modules, it is recognized that the switch guards could be used in applications outside of vehicle control switches. Accordingly, embodiments of the invention are not limited to use with vehicle control switches and it is understood that the scope of the invention extends to the use of switch guards for various other applications.

Figure 1:
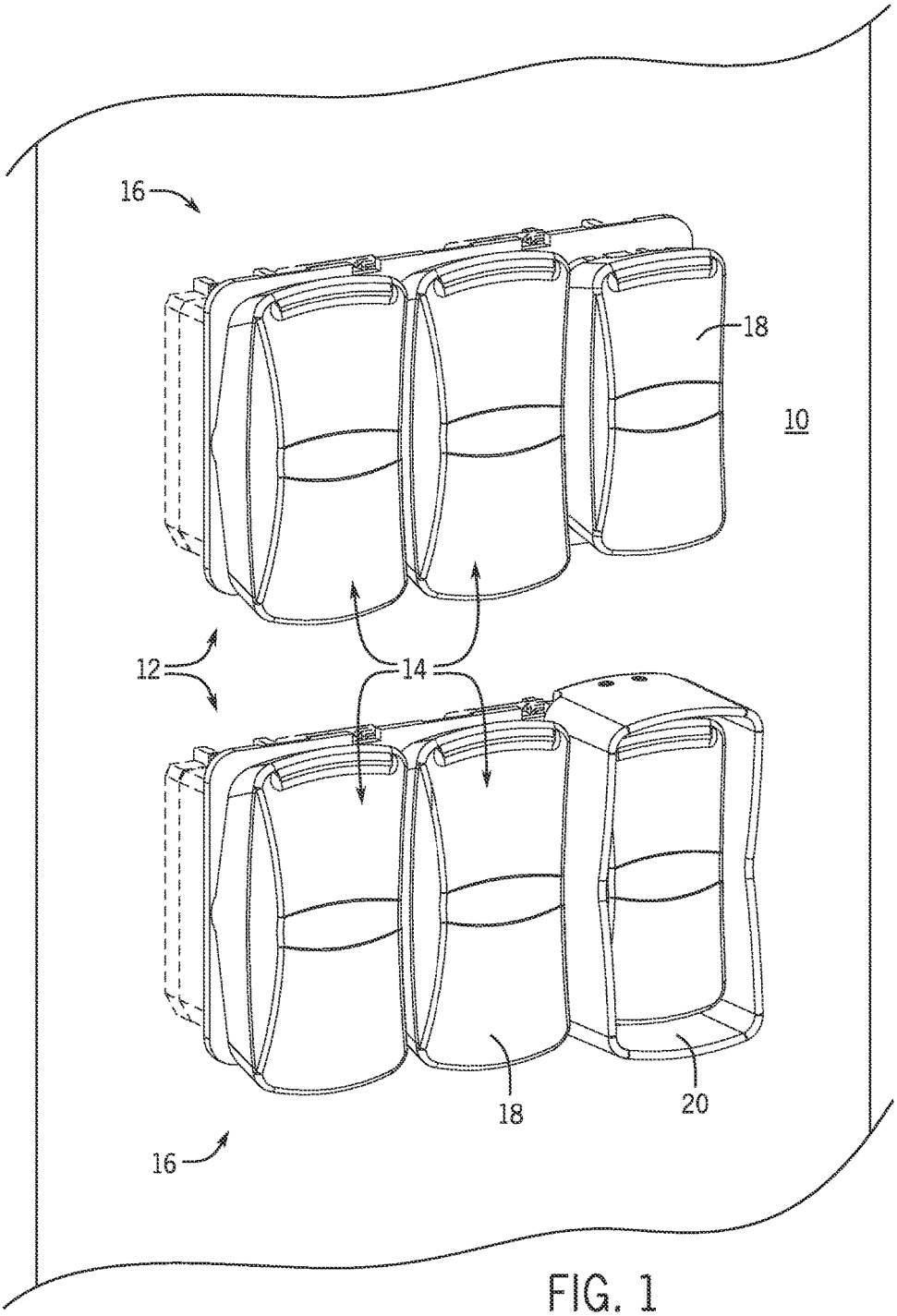
FIG. 1 shows a partial view of a vehicle dashboard including an arrangement of vehicle control switches, according to an embodiment of the invention.

Referring to FIG. 1, the general layout of a portion of a vehicle dashboard 10 having an arrangement 12 of vehicle control switches 14 is shown with which embodiments of the invention may be implemented. The switch arrangement 12 is incorporated as part of the dashboard 10 in a motor vehicle, such as a heavy truck, goods vehicle, agricultural equipment, or construction equipment, for example. An operator of the vehicle uses the vehicle control switches 14 to operate various functions in the vehicle, such as for switching the motor vehicle lighting, the windshield wipers, the diesel fuel heating, or controlling other specialized equipment on the vehicle—such as a power take-off (PTO) or "safety" related vehicle feature.

In the embodiment illustrated in FIG. 1, the switch arrangement 12 is divided into a number of switch modules 16—with each switch module 16 including a number of switches 14 therein. The switch module 16 includes communication ports and a power receptacle (not shown) formed on a back surface thereof to enable powering of the module and communication to/from the module, such as via mating of the modules 16 with a vehicle communication interface feature that enables the switch modules to communicate with a communication bus of the vehicle, such as a CAN or LIN bus, for example. It is recognized that a greater or smaller number of switch modules 16, and switches 14 per module, could be included in the switch arrangement 12, and that the arrangement of switches 14 in each module 16 could differ, such as the switches being arranged in a single row or in two rows, for example. Thus, the switch arrangement 12 illustrated in FIG. 1 is meant to be an example only and is not meant to limit the scope of the invention in any regard.

As shown in FIG. 1, the vehicle control switches 14 are constructed as rocker switches that include a rocker button 18 that is actuated/pushed by an operator to control operation of various functions in the vehicle. Each rocker button 18 is movable between a neutral/off position and one or two activated positions. That is, if the operator pushes one side of the rocker button 18, the button is moved to a first activated switch position, and if the operator pushes the other side of the rocker button 18, the button is moved to a second activated switch position. To aid in preventing accidental actuation of the rocker button 18 between the neutral and activated position(s), a switch guard 20 is provided that may be selectively positioned on/about a vehicle control switch 14 included in switch arrangement 12. In FIG. 1, a single vehicle control switch 14 is shown as including such a switch guard 20, but it is recognized that a greater number of switches 14 in the arrangement 12 could include such a guard.

Figure 2:
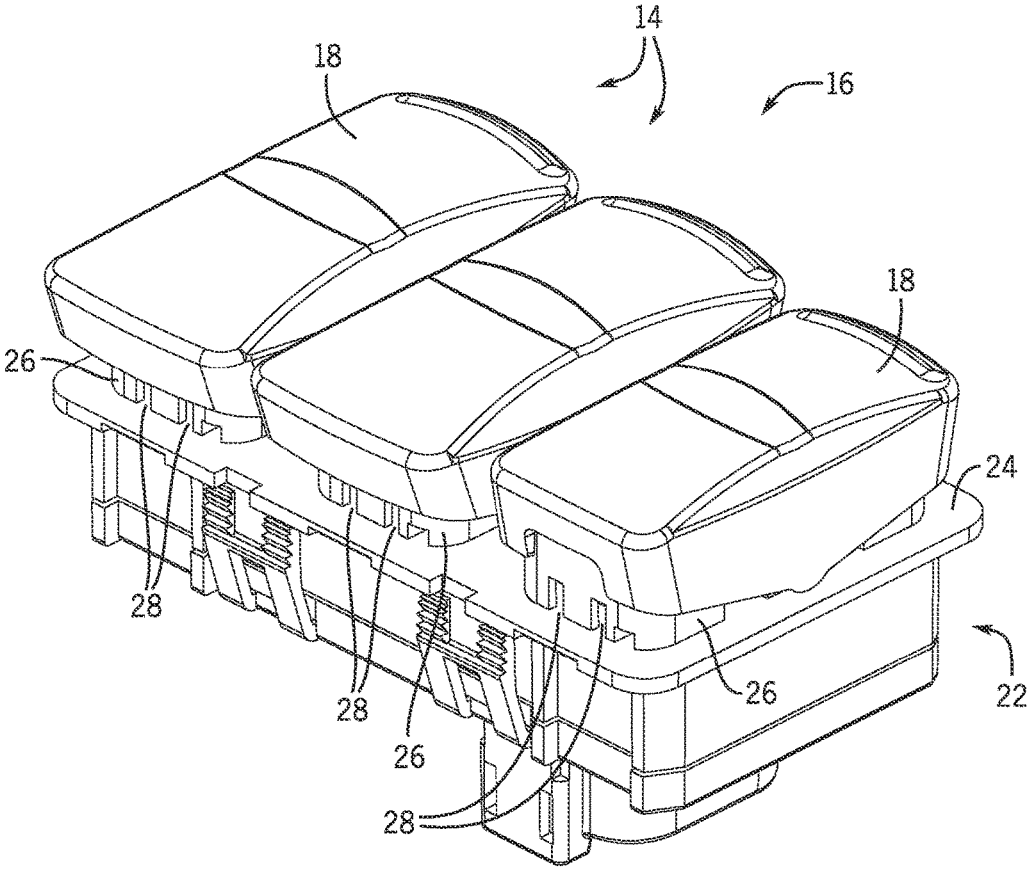
FIG. 2 is a perspective view of a switch module housing for the vehicle control switches of FIG. 1, according to an embodiment of the invention.
Figure 3:
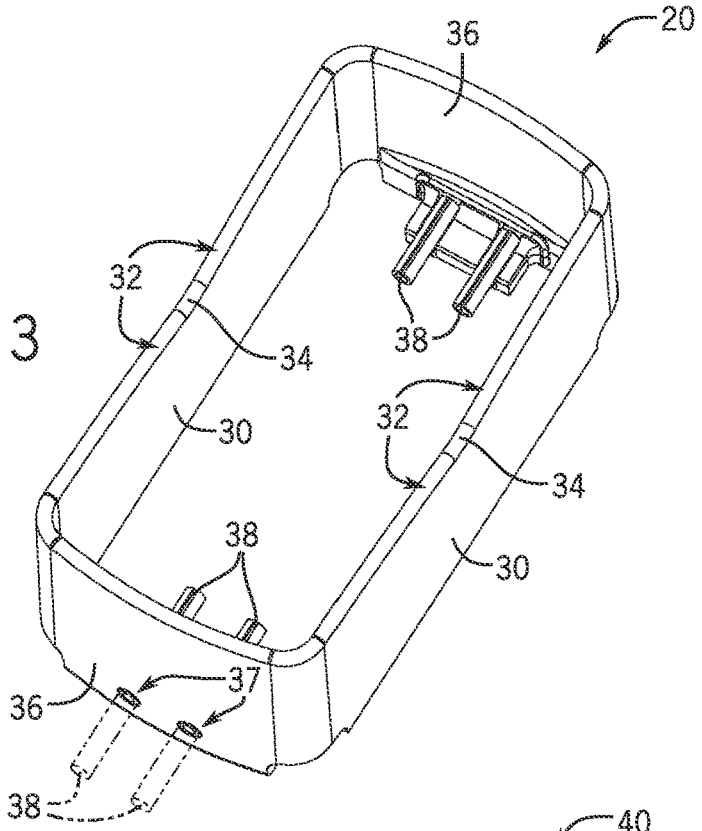
FIG. 3 is a perspective view of a switch guard useable with the switch module housing and vehicle control switches of FIGS. 1 and 2, according to an embodiment of the invention.

Referring now to FIGS. 2 and 3, features that provide for securing of one or more switch guards 20 to switches in a switch module 16 are shown and described in more detail. As first shown in FIG. 2, each switch module 16 is received in a switch module housing 22 that is fitted in the vehicle dashboard 10 (FIG. 1). The switch module housing 22 is configured to receive the individual switches 14 therein and includes a surface 24 that will be generally flush with the vehicle dashboard 10 when the housing 22 is fitted in the vehicle dashboard—so as to form a "sealed" switch module 16. The housing 22 also includes switch mounts 26 formed on the surface 24 that extend outwardly therefrom so as to enable mating of the switches 14 to/within the housing 22 in the correct alignment and orientation. Each of the switch mounts 26 of the housing 22 includes a number of mating holes or slots 28 formed therein that provide for securing of a switch guard 20 about a respective switch 14. When it is desired to secure a switch guard 20 about a rocker switch 14, the mating holes/slots 28 receive a corresponding mating feature of the switch guard 20 therein, as will be explained in greater detail below.

In FIG. 3, the switch guard 20 is shown in greater detail according to an exemplary embodiment of the invention. In general, the switch guard 20 is constructed as a rigid guard member—formed of hard plastic or metal, for example—that is not prone to deflection or bending when contacted by an operator, such that the switch guard 20 provides adequate protection to the rocker button 18 from accidental actuation. The switch guard 20 generally matches a shape of the rocker button 18 and thus includes a wall structure formed from a pair of side walls and a pair of end walls that extend continuously around the rocker button 18 so as to be positioned thereabout. According to one embodiment, the two side walls 30 of the switch guard 20 extend lengthwise along the rocker button 18 and include sloped portions 32 thereon that slope downwardly to meet at a midpoint 34 of the wall. The sloped portions 32 of the walls 30 enable an operator to affirmatively actuate the rocker button 18 with minimal interference from the switch guard 20, while still providing adequate protection against accidental actuation of the button. Each of the end walls 36 includes openings 37 formed therein that provide for mating of the switch guard 20 to the switch module housing 22.

As shown in FIG. 3, a mating feature is provided on each of opposing end walls 36 of the switch guard 20 that provides for securing of the switch guard 20 to the switch module housing 22 and about the rocker switch 14. According to an exemplary embodiment, the mating feature is formed as a pair of spring pins 38 on each wall 36 that are selectively depressible to provide for securing of the switch guard 20 to the switch module housing 22. The spring pins 38 have a body diameter that is larger than the diameter of openings 37, and a chamfer on either one or both ends to facilitate starting of the pin into the opening. The spring action of the spring pin 38 allows it to compress as it assumes the diameter of the opening 37. The radial force exerted by the spring pin 38 against the opening 37 retains it in the opening, such that the spring pin is a self retaining fastener.

Initially, the spring pins 38 are assembled partially into the switch guard 20 (i.e., retained within openings 37) and, in an initial position (i.e., "first position"), extend outwardly from the end walls 36, as shown in phantom in FIG. 3. When it is desired to secure the switch guard 20 about a respective rocker switch 14, the switch guard 20 is placed onto the switch module housing 22, the diameter of the spring pins 38 is reduced by applying a radial force thereto, and the spring pins 38 are then pushed-in fully through the openings 37 on the end walls 36 and into the mating holes/slots 28 (FIG. 2) in the switch module housing 22 (to a "second position"), so as to secure the spring pins 38 within the opening 37 and mating holes/slots 28 and lock the switch guard 20 onto the switch module housing 22.

Figure 4:
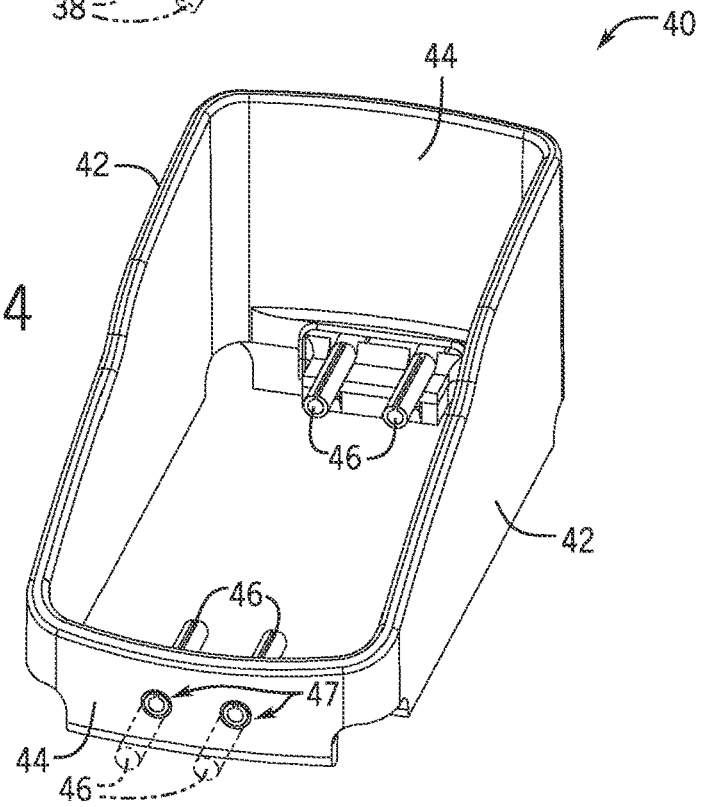
FIG. 4 is a perspective view of a switch guard useable with the switch module housing and vehicle control switches of FIGS. 1 and 2, according to an embodiment of the invention.

Referring now to FIG. 4, a switch guard 40 useable with the rocker switches 14 of the switch modules 16 is shown according to another embodiment of the invention. In general, the switch guard 40 is constructed similar to the switch guard 20 shown in FIG. 3, in that the guard 40 is constructed as a rigid guard member (i.e., formed of hard plastic or metal) formed of a pair of side walls 42 and a pair of end walls 44 that are arranged/sized such that the guard generally matches the shape of the rocker button 18 (FIG. 1). A pair of spring pins 46 is provided on each of opposing end walls 44 of the switch guard 40 that are selectively depressible to provide for securing of the switch guard 40 to the switch module housing 22—with the spring pins 46 being pushed through openings 47 in end walls 44 and into mating holes/slots 28 (FIG. 2) in the switch housing 22, so as to lock the switch guard 40 onto the housing. However, different from the switch guard 20 of FIG. 3, switch guard 40 is constructed as a "half guard" where one half of the switch guard is reduced in height as compared to the other half. The two side walls 42 of the switch guard are formed to slope downwardly from a higher end wall 44 on one end of the switch guard 40 down to an end wall 44 of reduced height. Accordingly, one end wall 44 extends up past a top surface of the rocker button 18, while the other end wall 44 has a height such that it is below a top surface of the rocker button 18. The "half guard" switch guard 40 may be desirable for a rocker switch 14 having only one activated position—where preventing accidental actuation to this one position is needed—or may be desirable to generally provide easier actuation of the rocker button 18 (as compared to the switch guard of FIG. 3).

Figure 5:
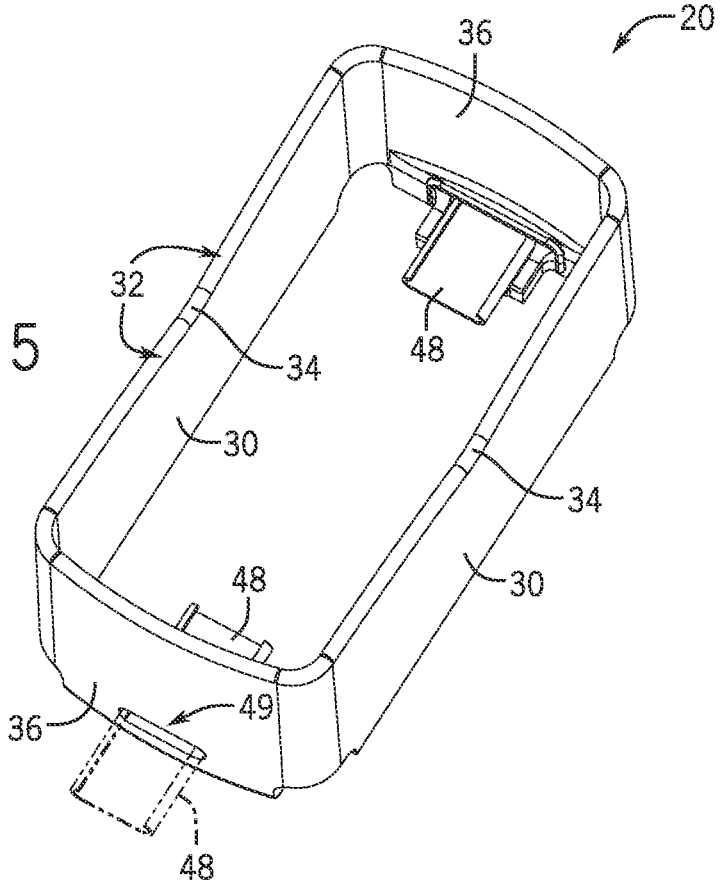
FIG. 5 is a perspective view of a switch guard useable with the switch module housing and vehicle control switches of FIGS. 1 and 2, according to an embodiment of the invention.

In each of the switch guards 20, 40 of FIGS. 3 and 4, it is recognized that the construction of the mating feature may be varied from that which is shown. For example, rather than having a pair of spring pins 38, 46 on each end wall, it is recognized that a unitary feature that is selectively depressible—i.e., a single spring pin or spring blade 48—could instead be employed for securing of the switch guard 20, 40 to the switch module housing 22, as shown in FIG. 5. When moved from a first position (shown in phantom) to a second position extending into the interior of the switch guard 20, the spring blade 48 would mate with a corresponding single mating slot/hole 28 (i.e., the two openings 28 in FIG. 2 would be a single opening) formed in the switch mount 26 of the switch module housing 22. In still a further embodiment, a latch feature (not shown) could be included on a blade for securing the blade to the switch guard 40 and/or for securing the blade to the switch module housing 22, or a latch feature could be formed on the switch guard for holding the blade to the switch guard.

Figure 6:
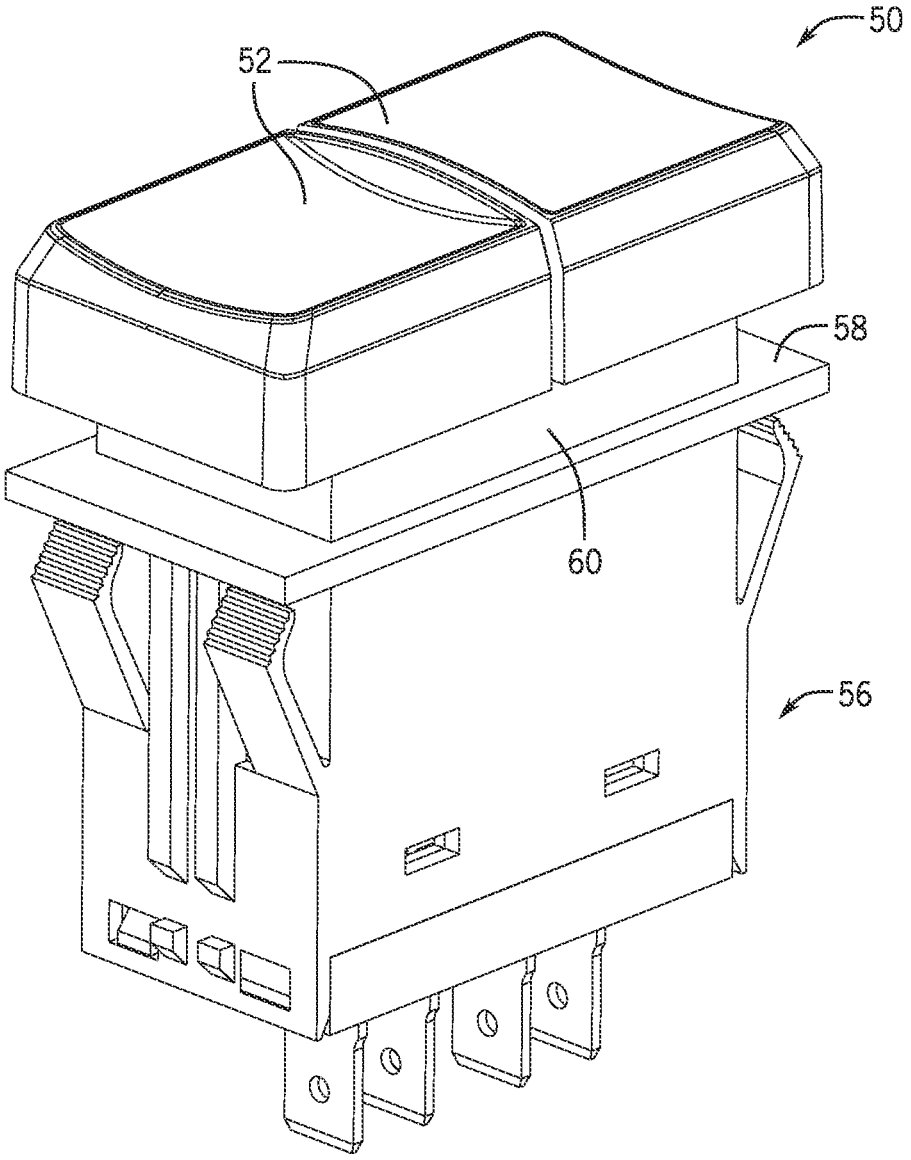
FIG. 6 is a perspective view of a dual pushbutton switch useable with embodiments of the invention
Figure 7:
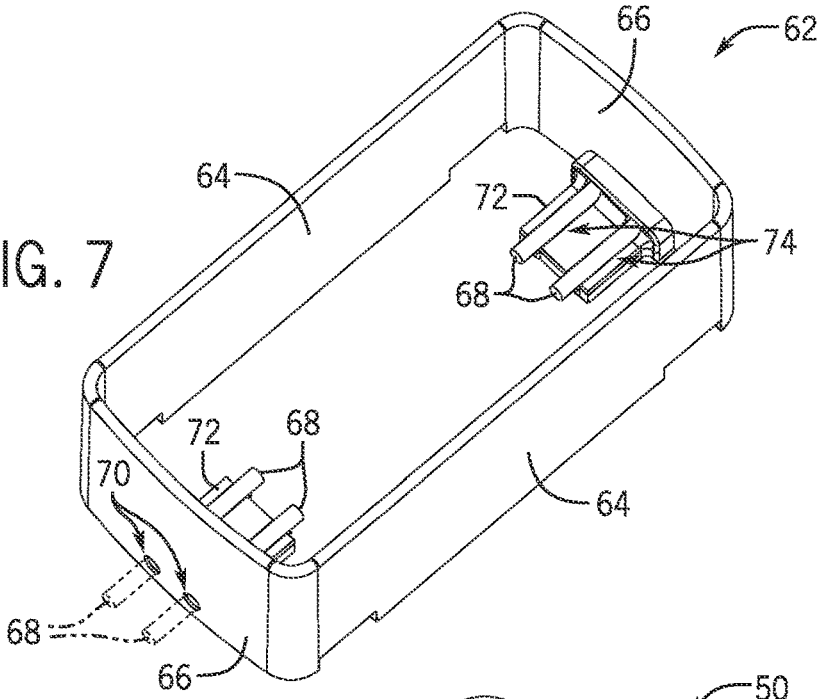
FIG. 7 is a perspective view of a switch guard useable with the dual pushbutton switch of FIG. 6, according to an embodiment of the invention.
Figure 8:
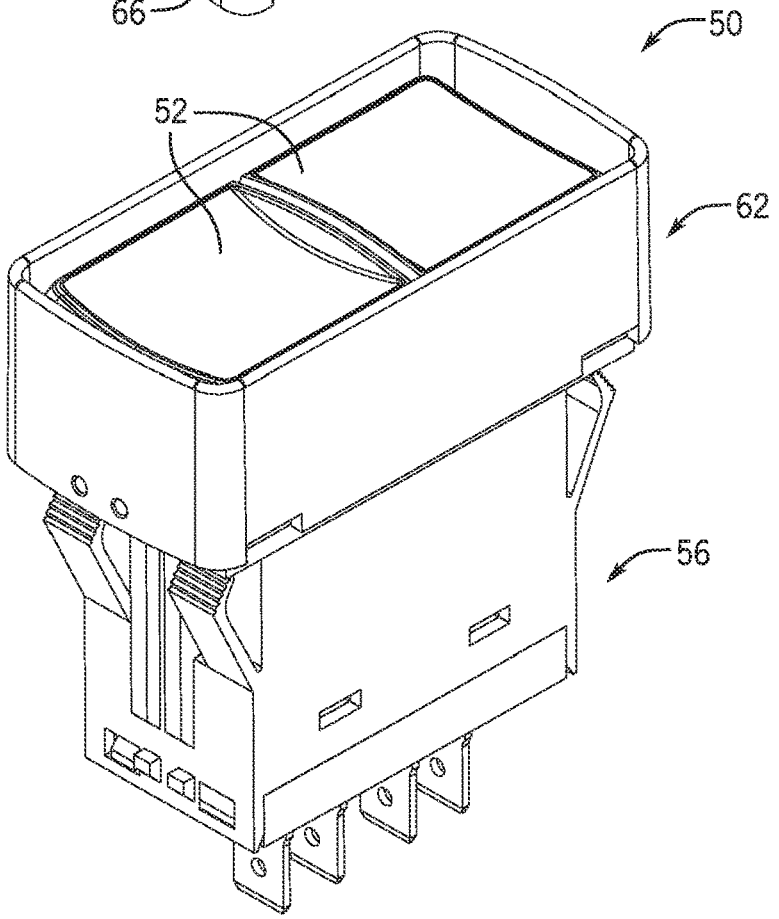
FIG. 8 is a perspective view of the switch guard of FIG. 7 secured to the dual pushbutton switch of FIG. 6.

Referring now to FIGS. 6-8, use of a switch guard with a dual pushbutton switch is illustrated according to another embodiment of the invention. A dual pushbutton switch 50 is illustrated in FIG. 6 (such as could be incorporated as part of a vehicle dashboard) that includes a pair of pushbuttons 52 that are actuated/pushed by an operator to control operation of various functions in a vehicle. The dual pushbutton switch 50 also includes a switch housing 54 that is fitted in the vehicle dashboard 10 (FIG. 1). The housing 54 is configured to receive the pair of pushbuttons 52 therein and includes a surface 56 that will be generally flush with the vehicle dashboard when the housing 54 is fitted in the vehicle dashboard. The housing 56 also includes a pushbutton mount 60 formed on the surface 58 that extends outwardly therefrom so as to enable mating of the pushbuttons 52 to/within the housing 56.

In FIG. 7, a switch guard 62 useable with the dual pushbutton switch 50 is shown in greater detail according to an exemplary embodiment of the invention. The switch guard 62 is constructed similar to the switch guard shown in FIG. 3, in that the guard 62 is constructed as a rigid guard member (i.e., formed of hard plastic or metal) formed of a pair of side walls 64 and a pair of end walls 66 that are arranged/sized such that the guard 62 generally matches the shape of the pair of pushbuttons 52. As shown in FIG. 7, the switch guard 62 has a uniform height around the perimeter thereof to specifically accommodate the dual pushbutton switch 50. For securing the switch guard 62 to the switch housing 56, spring pins 68 are provided on each of opposing end walls 66 of the switch guard 60 (positioned within openings 70 on the end walls 66) that interact with the switch housing 56 (i.e., with mount 60) to provide for securing of the switch guard to the housing and about the pair of pushbuttons 52. The spring pins 68 are movable from a first position where they are positioned outside the switch guard 62 to a second position where they extend into an interior volume of switch guard 62 (defined by walls 64, 66). In moving to the second position, the spring pins 68 slide within a bracket or flange 72 with tracks 74 formed therein that guide/support the pins to a desired location. When in the second position, the spring pins 68 exert a radial force against the end walls 66 (against the openings 70) to retain the spring pins 68 in a fixed position in the openings 70 and thereby secure the switch guard 62 to the switch housing 56. Accordingly, as best shown in FIG. 8, the switch guard 62 may be secured to the dual pushbutton switch 50 to prevent the accidental pressing of the pushbuttons 52 by an operator. Beneficially, positioning of the switch guard 62 on the dual pushbutton switch 50 does not interfere with the switch's ability to be sealed (if required), as opposed to existing switch guard designs.

According to yet an additional embodiment, a switch guard may be provided to prevent accidental actuation of a toggle switch. In such an embodiment, the toggle switch would include a switch housing similar to the switch housing shown in FIG. 6 and the switch guard would be constructed similarly to the switch guard shown in FIG. 6. The switch guard would function to prevent accidental toggling of the switch by surrounding the switch and having it recessed within the switch guard.

Beneficially, embodiments of the invention thus provide a switch guard formed of a rigid material that is not prone to deflection or bending when contacted by an operator, such that the switch guard provides adequate protection to a switch (e.g. vehicle control switch such as a rocker switch, pushbutton switch, or toggle switch) from accidental actuation. Because of the spring pins/blade included on the switch guard, the switch may be easily added onto the switch—with the combination of a very rigid plastic for the guard and the metallic pins providing a very high strength for the switch guard. The guard can be assembled to a switch or switch module housing by the manufacturer or, conversely, in a retrofittable fashion by the customer who will use the switch in their products. As such, a customer is able to stock only unguarded switches and add the switch guard as necessary, rather than stocking both guarded and unguarded switches. This is especially valuable for multi-switch modules (i.e., three or more rocker switches in one housing), as the number of possible combinations of guarded and unguarded positions is very large. As the switch guard is selectively addable, the guard allows the customer to stock one unguarded multi-switch module, and add the guards where needed.

Therefore, according to one embodiment of the present invention, a switch guard for preventing accidental actuation of a control switch includes a rigid wall structure comprising a pair of side walls and a pair of end walls arranged to accommodate positioning of the control switch therein, each of the pair of end walls including at least one opening formed therein. The switch guard also includes a mating feature provided at each of the end walls of the wall structure, with each mating feature being a separate component from the rigid wall structure and being configured to selectively translate through the at least one opening formed in the respective end wall between a first position and a second position to secure the switch guard about the control switch.

According to another embodiment of the present invention, a vehicle control switch includes a control switch switchable between ON and OFF states responsive to physical actuation of the control switch by an operator, the physical actuation comprising an application of force onto the control switch by the operator. The vehicle control switch also includes a switch housing to receive the control switch therein, with the switch housing comprising a switch mount having one or more mating slots formed therein. The vehicle control switch further includes a switch guard secured to the switch housing and positioned about the control switch, the switch guard having a wall structure defining a volume to receive the control switch therein and a depressible mating feature positioned on each of opposing ends of the wall structure, the depressible mating feature configured to selectively mate with the one or more mating slots formed in the switch housing to secure the switch guard to the switch housing.

According to yet another embodiment of the present invention, a retrofittable rocker switch guard for preventing accidental actuation of a rocker switch includes a rigid wall structure configured to accommodate positioning of a rocker switch therein, the rigid wall structure including one or more openings formed on each of opposing ends thereof. The retrofittable rocker switch guard also includes a spring pin retained in each of the one or more openings and being translatable therethrough to provide securing of the rigid wall structure about the rocker switch, wherein each spring pin is depressible so as to vary a diameter thereof from a diameter larger than a diameter of its respective opening in which it is retained to a diameter that provides for placement of the spring pin within the opening and translation therethrough, and wherein each spring pin exerts a radial force against the opening in which it is retained so as to secure the spring pin in the opening in a fixed position.

The present invention has been described in terms of the preferred embodiment, and it is recognized that equivalents, alternatives, and modifications, aside from those expressly stated, are possible and within the scope of the appending claims.

What is claimed is:

1. A switch guard for preventing accidental actuation of a control switch, the switch guard comprising:

a rigid wall structure comprising a pair of side walls and a pair of end walls arranged to accommodate positioning of the control switch therein, each of the pair of end walls including at least one opening formed therein; and a mating feature provided at each of the end walls of the wall structure, each mating feature being a separate component from the rigid wall structure and being configured to selectively translate through the at least one opening formed in the respective end wall between a first position and a second position to secure the switch guard about the control switch;

wherein the rigid wall structure extends continuously around the control switch so as to completely surround a perimeter of the control switch, with the pair of side walls and the pair of end walls being oriented so as to each extend outwardly and upwardly relative to the control switch; and wherein at least one of the pair of end walls has a height that extends up past a top surface of the control switch.

2. The switch guard of claim 1 wherein the mating feature provided at each of the end walls of the wall structure comprises a pair of spring pins or a single spring blade, with each of the pair of spring pins or the single spring blade having a body diameter that is larger than a diameter of its respective opening in the end wall, with the spring pins or spring blade being selectively depressible to reduce the diameter thereof and provide for translation thereof through its respective opening between the first position and the second position.

3. The switch guard of claim 2 wherein, when in the second position, the pair of spring pins or the single spring blade extends inwardly into a volume surrounded by the wall structure to mate with at least one hole or slot formed in a housing to which the control switch is attached, thereby securing the switch guard to the housing and about the control switch.

4. The switch guard of claim 2 wherein the mating feature provided at each of the end walls of the wall structure comprises a pair of spring pins, and wherein the at least one opening formed in each end wall comprises a pair of openings.

5. The switch guard of claim 2 wherein the mating feature provided at each of the end walls of the wall structure comprises a spring blade, and wherein the at least one opening formed in each end wall comprises a single opening.

6. The switch guard of claim 1 wherein the control switch comprises a rocker switch, with each of the pair of end walls having a height that extends up past a top surface of the rocker switch; and wherein each of the pair of side walls of the rigid wall structure comprises a pair of sloped portions that slope downwardly from a respective end wall to meet at a midpoint of the side wall, with the midpoint being at a height that is less than the height of the pair of end walls.

7. The switch guard of claim 1 wherein the rigid wall structure comprises a half guard where one end wall is reduced in height as compared to the other end wall and where the two side walls slope downwardly from the other end wall to the end wall of reduced height.

8. The switch guard of claim 1 wherein the rigid wall structure is formed of a hard plastic or metal.

9. A vehicle control switch comprising:

a rocker switch switchable between a first activated position, a second activated position and an off position responsive to physical actuation of the rocker switch by an operator, the physical actuation comprising an application of force onto the rocker switch by the operator;

a switch housing to receive the rocker switch therein, the switch housing comprising a switch mount having one or more mating slots formed therein; and a switch guard secured to the switch housing and positioned about the rocker switch, the switch guard comprising:

a wall structure defining a volume to receive the rocker switch therein; and a depressible mating feature positioned on each of opposing ends of the wall structure, the depressible mating feature configured to selectively mate with the one or more mating slots formed in the switch housing to secure the switch guard to the switch housing;

wherein the wall structure comprises a pair of side walls and a pair of end walls, with each of the pair of end walls having a height that extends up past a top surface of the rocker switch so as to prevent accidental actuation of the rocker switch to the first activated position and the second activated position by the operator.

10. The vehicle control switch of claim 9 wherein the wall structure comprises one or more openings formed in end walls at opposing ends thereof, and wherein the mating feature positioned on each of opposing ends of the wall structure comprises one or more spring pins.

11. The vehicle control switch of claim 10 wherein each of the one or more spring pins has a body diameter that is larger than a diameter of a respective opening in the end wall, with each spring pin being selectively depressible to reduce the diameter thereof and provide for translation thereof through its respective opening between a first position and a second position.

12. The vehicle control switch of claim 11 wherein, when in the second position, each of the one or more spring pins is positioned in a respective mating slot formed in the switch housing, thereby securing the switch guard to the switch housing and about the rocker switch.

13. The vehicle control switch of claim 9 wherein the rocker switch comprises one of a plurality of rocker switches in a switch module, and wherein the switch housing comprises a switch module housing configured to receive a plurality of rocker switches therein, with the depressible mating feature selectively mating with the one or more mating slots formed in the switch module housing to secure the switch guard to the switch module housing.

14. A retrofittable rocker switch guard for preventing accidental actuation of a rocker switch, the retrofittable rocker switch guard comprising:

a rigid wall structure configured to accommodate positioning of a rocker switch therein, the rigid wall structure comprising a pair of side walls and a pair of end walls, with each of the end walls including one or more openings formed therein; and a spring pin retained in each of the one or more openings and being translatable therethrough to provide securing of the rigid wall structure about the rocker switch, wherein each spring pin is depressible so as to vary a diameter thereof from a diameter larger than a diameter of its respective opening in which it is retained to a diameter that provides for placement of the spring pin within the opening and translation therethrough;

wherein each spring pin exerts a radial force against the opening in which it is retained so as to secure the spring pin in the opening in a fixed position; and wherein at least one of the pair of end walls has a height that extends above a height of the rocker switch.

15. The retrofittable rocker switch guard of claim 14 wherein each spring pin is translatable between a first position and a second position, with the spring pin extending inwardly into a volume surrounded by the wall structure when in the second position; and wherein, when the spring pin is in the second position, the spring pin mates with at least one hole or slot formed in a switch housing to which the rocker switch is attached, thereby securing the switch guard to the switch housing and about the rocker switch.

16. The retrofittable rocker switch guard of claim 14 wherein the rigid wall structure comprises a pair of side walls and a pair of end walls, with each of the pair of side walls of the rigid wall structure comprising a pair of sloped portions that slope downwardly from a respective end wall to meet at a midpoint of the side wall.

17. The retrofittable rocker switch guard of claim 14 wherein the rigid wall structure comprises a pair of side walls and a pair of end walls, and wherein the rigid wall structure comprises a half guard where one end wall is reduced in height as compared to the other end wall and where the pair of side walls slope downwardly from the other end wall to the end wall of reduced height.

18. The vehicle control switch of claim 9 wherein the wall structure extends continuously around the rocker switch so as to completely surround a perimeter of the rocker switch.

19. The vehicle control switch of claim 18 wherein a shape of the wall structure substantially matches a shape of the perimeter of the rocker switch.

* * * * *